United States Patent [19]

Dunning

[11] 4,277,059

[45] Jul. 7, 1981

[54] SHEET FEEDER FOR TYPEWRITERS

[75] Inventor: Gordon R. Dunning, Versailles, Ky.

[73] Assignee: International Business Machines Corporation, Armonk, N.Y.

[21] Appl. No.: 131,324

[22] Filed: Mar. 18, 1980

[51] Int. Cl.[3] ..... B65H 3/20

[52] U.S. Cl. ..... 271/23

[58] Field of Search ..... 271/23, 111, 114, 165, 271/225

[56] References Cited

U.S. PATENT DOCUMENTS

| | | | |
|---|---|---|---|
| 715,764 | 12/1902 | Dick | 271/23 |
| 2,280,964 | 4/1942 | Mixer | 271/23 |

*Primary Examiner*—Richard A. Schacher

*Attorney, Agent, or Firm*—William J. Dick

[57] ABSTRACT

An improved sheet paper feed apparatus for a printing apparatus having a platen for holding and providing at least longitudinal motion to a sheet of paper. The sheet feed apparatus comprises a rectangular tray including a rear paper support portion and a spaced apart forward paper support portion, the portions for supporting thereon the opposite ends of a stack of paper. A shingler wheel is positioned intermediate the support portions for engaging the lowermost sheet of the paper sheet stack, and the shingler wheel is rotated in a first direction to move the lowermost sheet of the stack away from the forward support portion until the lowermost sheet is no longer supported thereby, and then in the opposite direction to drive the lowermost sheet beneath the forward paper support portion, the forward paper support portion comprising in the preferred embodiment a pair of inwardly projecting, spaced apart fingers. The improvement includes a cover member mounted for rotation on the tray and dimensioned to fit within the tray superimposed of the stack of papers. A paper stack lift is mounted adjacent the fingers and moves between a first recessed position below the plane of the fingers and a second position above the plane of the fingers. The cover means is coupled to the stack lift so that upon rotation of the cover member away from the stack, the stack lift assumes the second position and when the cover is in place superimposed of the stack, the lift is in the first position.

12 Claims, 4 Drawing Figures

SHEET FEEDER FOR TYPEWRITERS

CROSS-REFERENCE TO OTHER APPLICATIONS

This application claims an invention disclosed in a co-pending patent application Ser. No. 85,826, of P. A. Quinn, Jr. and entitled "Sheet Feeder for Typewriter", filed on Oct. 17, 1979.

SUMMARY OF THE INVENTION AND STATE OF THE PRIOR ART

The present invention relates to sheet paper feed apparatus for a typewriter, and more particularly relates to bottom sheet paper feed apparatus including means for facilitating the loading of a bundle or stack of paper into the sheet feed apparatus and separating the bundle or stack from finished typed sheets.

Shingling apparatus for separating sheets and feeding the same have been in existance for some time. For example, see U.S. Pat. No. 3,008,709, issued on Nov. 14, 1961 to Booslik. The uses of such shingling apparatus has been varied but conventionally has been employed in conjunction with some normal force to remove either the topmost or bottommost sheet from the stack of sheets of paper. Typical bottom sheet shingling apparatus is illustrated in IBM Technical Disclosure Bulletin, Vol. 21, No. 9, February 1979, pages 3538, 3539; and 3540–3542; and U.S. Pat. No. 4,165,870, issued on Aug. 28, 1979 to John L. Fallon, et al.

In feeding, when desired, individual sheets of paper to the platen of a typewriter from a sheet feeder, it is advantageous if the sheet feeder can deliver a single sheet of paper to the platen of the typewriter without additional drive or feed rolls which tend to complicate the apparatus. With bottom sheet feeders, it is mandatory that the stack of sheets of paper (or bundle) be disposed precisely with respect to its leading edge, especially in a sheet feeder of the type disclosed herein, to inhibit paper jam up due to improper loading.

In view of the above, it is a principle object of the present invention to provide means for insuring proper positioning of a bundle of papers in a bottom sheet feed apparatus.

Another object of the present invention is to provide, in conjunction with the automatic paper positioning means, a cover for providing weight against the paper stack, which cover simultaneously operates as a separator for completed or typed sheets of paper to facilitate removal by the machine operator.

Other obects and a more complete understanding of the invention may be had by referring to the following specification and claims taken in conjunction with the accompanying drawings in which:

DRAWING DESCRIPTION

Figure 1:
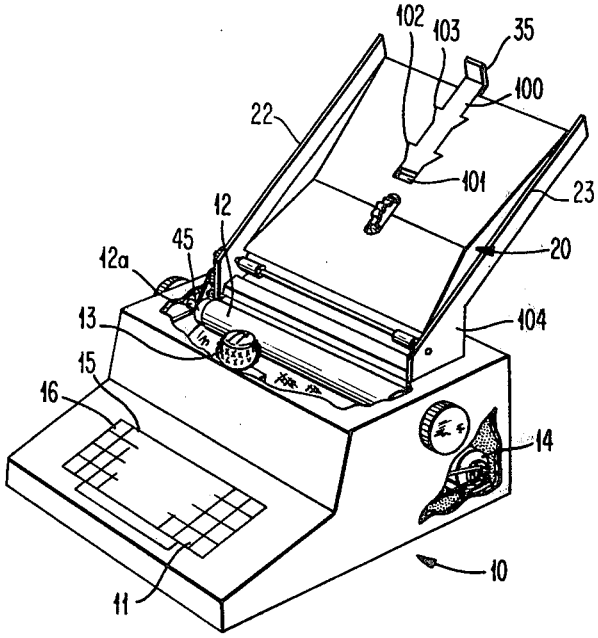
FIG. 1 is a fragmentary perspective view of a typewriter incorporating a sheet paper feed apparatus constructed in accordance with the present invention.

Referring now to the drawings and especially FIG. 1 thereof, a typical single element typewriter 10 having a sheet feeder 20 incorporating the features of the present invention is illustrated therein. As shown, the typewriter 10 includes a keyboard and the like 11, a platen 12 and a typing element 13 which moves longitudinally of the platen 12 by means of a carrier (not shown) to imprint through, for example ribbon, indicia on paper wound in a conventional manner around the platen 12. In the present instance, the typewriter 10 includes a stepping motor and the like 14 which is coupled to the platen 12 to effect indexing of the platen (and thus a sheet or sheets of paper) either under operation of the operator as through a keybutton 15, automatically through preprogramming or through the conventional carrier return key located on the typewriter.

The sheet feeder, including its simple electronics is described more fully in co-pending patent application Ser. No. 85,826 of Quinn, filed on Oct. 17, 1979 and owned by the assignee of the present invention, that application being herein incorporated by reference. The sheet feeder 20 is adapted to receive a stack or bundle of sheets of paper, remove the bottom sheet from the bundle and present the same to the platen 12 of the typewriter, and receive the finished sheet, if desired, from the platen. This is accomplished by first shingling the stack or bundle so that the bottommost sheet moves in a first direction away from the typewriter platen, and upon sensing of the single sheet, the direction of movement of the shingler wheel is reversed to place the individual sheet between the nip of drive rolls which are conveniently coupled to the platen. Thereafter the paper is fed to the platen so that as the platen rotates, the paper sheet is removed from the sheet feeder. To this end, and referring now to FIGS. 1-4, the sheet feeder comprises a generally rectangular tray 21 having upstanding sidewalls 22 and 23 which are spaced apart a sufficient distance to receive a bundle or stack of paper 30 upon which characters or other indicia may be imprinted by the typewriter 10. The tray includes a rear paper bundle or stack support portion 24, and a spaced apart forward paper support portion 25, the rear paper support portion 24 comprising a ledge or shelf while the forward paper support portion preferably comprises a pair of laterally spaced apart projecting fingers 26 and 27. As best illustrated in FIG. 3, the forward and rear paper support portions 25 and 24 respectively are spaced apart so as to provide an opening 28 therebetween for receiving at least one shingler wheel 29 which projects upwardly into the space 28 above the plane formed by connecting the rear paper support portion 24 and the forward support portion 25 so that a stack of paper 30, supported by the rear support portion 24 and forward support portion 25, will rest intermediate its ends upon the shingler wheel 29 holding the paper stack or bundle 30 in a slightly bowed configuration (see FIG. 4). Thus the shingler wheel 29 engages the bottommost sheet 30*a* of the paper sheet stack 30.

In order to impart rotation to the shingler wheel 29 to remove the bottommost sheet 30*a* from the bundle or stack 30, drive means 31, for example a DC motor is coupled through a belt 32 to a pulley 33 mounted on a shaft 34 upon which is mounted the shingler wheel 29. For noise and vibration inhibiting purposes, the DC motor 31, shingler wheel 29 as well as other portions of the apparatus are mounted on a shock mounted platform 31*a*.

Upon depression of a pack or paper feed button 16 on the typewriter keyboard 11, (FIG. 1) the DC motor drive means 31 will effect rotation of the shingler wheel 29 in a direction to effect shingling of the lower sheet 30*a* of the stack or bundle 30 in a first direction which is upwardly or away from the platen 12 of the typewriter (hereafter, up refers to the direction of sheet movement away from the platen and down refers to the direction of sheet movement towards the platen). Shingling continues until the lowermost sheet 30*a* is driven so that its lower edge 30*b* drops off the forward support portion 25 or off the fingers 26 and 27. This condition is sensed by an upper or top sensor 35 which causes a reversal of the direction of motion of the DC motor 31 and thus a reversal in the direction of the motion of the shingler wheel 29.

After sensing of the bottommost sheet 30*a* of paper, by the sensor 35, and reversal of the motor drive 31 of the shingler 29, the bottommost sheet 30*a*, having dropped below the forward support portion 25 or fingers 26 and 27, is fed into and between driven rollers 40 and idler rollers 40*a* which are mounted beneath each of the fingers 26 and 27. In this connection, it should be noted that the portion 25 includes a downwardly deflecting camming surface 25*a* beneath the fingers 26 and 27 to aid in sheet separation and guidance of the sheet, the fingers also mounting the idler rollers 40*a* (FIG. 4). Adjacent the driven roller 40 is a second sensor means or a lower sensor 36 (FIG. 3) which serves to shut off the drive motor 31 stopping the shingling action.

In order to drive the roller 40 to effect feeding of the sheet of paper 30*a* through a slot like opening 50 to the platen 12 of the typewriter, in the preferred embodiment, the roller 40 which underlies both of the fingers 26 and 27 is connected to a shaft 41 which extends transversely of the tray 21 terminating in a gear 42 (FIG. 2) which is coupled through a driven gear 43 to a second driven gear 44, the purpose of the second driven gear 44 being more fully explained hereinafter. Preferably a belt 43*a* may be employed to connect the driven gear 43 to the typewriter platen, or any other convenient drive which would allow either manual rotation of the platen to effect removal of the paper, or motorized movement of the platen as by the motor 14 associated with the typewriter to move the paper throgh the platen to a start of typing or print position. It should be recognized, however, that the coupling of the roller 40 to effect rotation thereof may be by any convenient mode or means to the platen 12, or to another drive source, it only being necessary that the lowermost sheet 30*a* of paper is fed through the chute like slot 50 into the platen. Alternately, the driven gear 42 may be coupled to the gear 45 (see FIG. 1) on the platen shaft 12*a* so that rotation of the platen effects rotation of the drive gear 42 and thus the gears 43 and 44.

In order to remove paper from the platen, the second driven gear 44 is coupled as by a shaft 45*a* (see FIGS. 2, 3 and 4) which also extends laterally of the tray 21, the shaft 45*a* being connected to a pair of spaced apart driven rollers 46 which serve to press the paper against the idler rollers 47 to effect removal of the paper from the platen and place the finished sheet of paper superimposed of the stack 30.

The operation of the shingler wheel 29 and the cooperation in the driving action by the sensors 35 and 36 is completely explained in the co-pending patent application, above identified. However, it should be recognized that the sheet feeder may be controlled by a simple timing device which permits a time out of the amount of time taken to move a bottom sheet during the operation of the shingler upwards or away from the platen and then a simple motor reversal with a sufficient time to permit movement of that bottom sheet beneath the ledge or fingers 26 and 27. Moreover, a simple electromechanical sensor such as a microswitch with a latching circuit may also be employed to control the direction of rotation of the drive motor and its on and off.

In accordance with the invention, in order to prevent inadvertent errors by the machine operator in failing to properly place the paper bundle 30 on the forward support 25, (fingers 26 and 27) which may cause a paper jam due to paper slipping under the fingers, as well as on the rear paper support portion 24, means are provided to insure placement of the bundle on the forward support portion 25. To this end, a paper stack lift, support or shelf 90 having cutouts 91 and 92 (FIG. 3) mating with the fingers 26 and 27 is hingeably connected, as by a pivot shaft 90*a*, to a support 90*b* on the shock mounted platform 31*a* to initially support the bottom edge of the paper stack when it is placed onto the tray on the rear paper support portion 24. As will be more fully explained hereinafter, the support 90 is operated by actuator means, in the present instance a cover 95 which must be lifted by the operator about a pivot shaft 96 when the operator loads paper into the tray onto the rear support portion 24 and the support 90.

Figure 2:
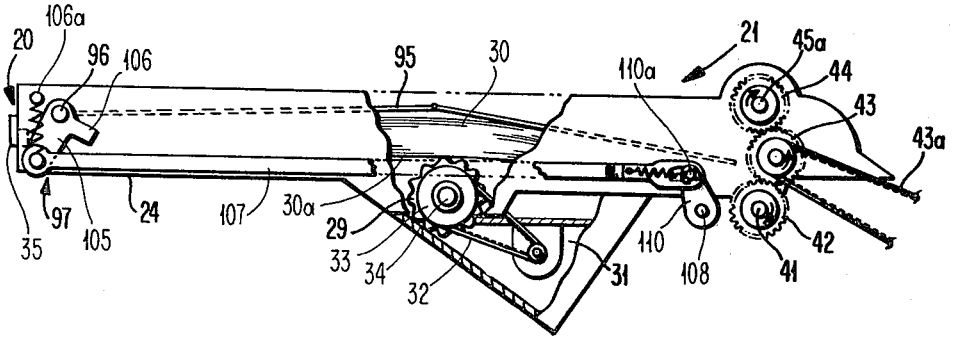
FIG. 2 is a fragmentary side elevational view of the sheet feeder illustrated in FIG. 1.
Figure 3:
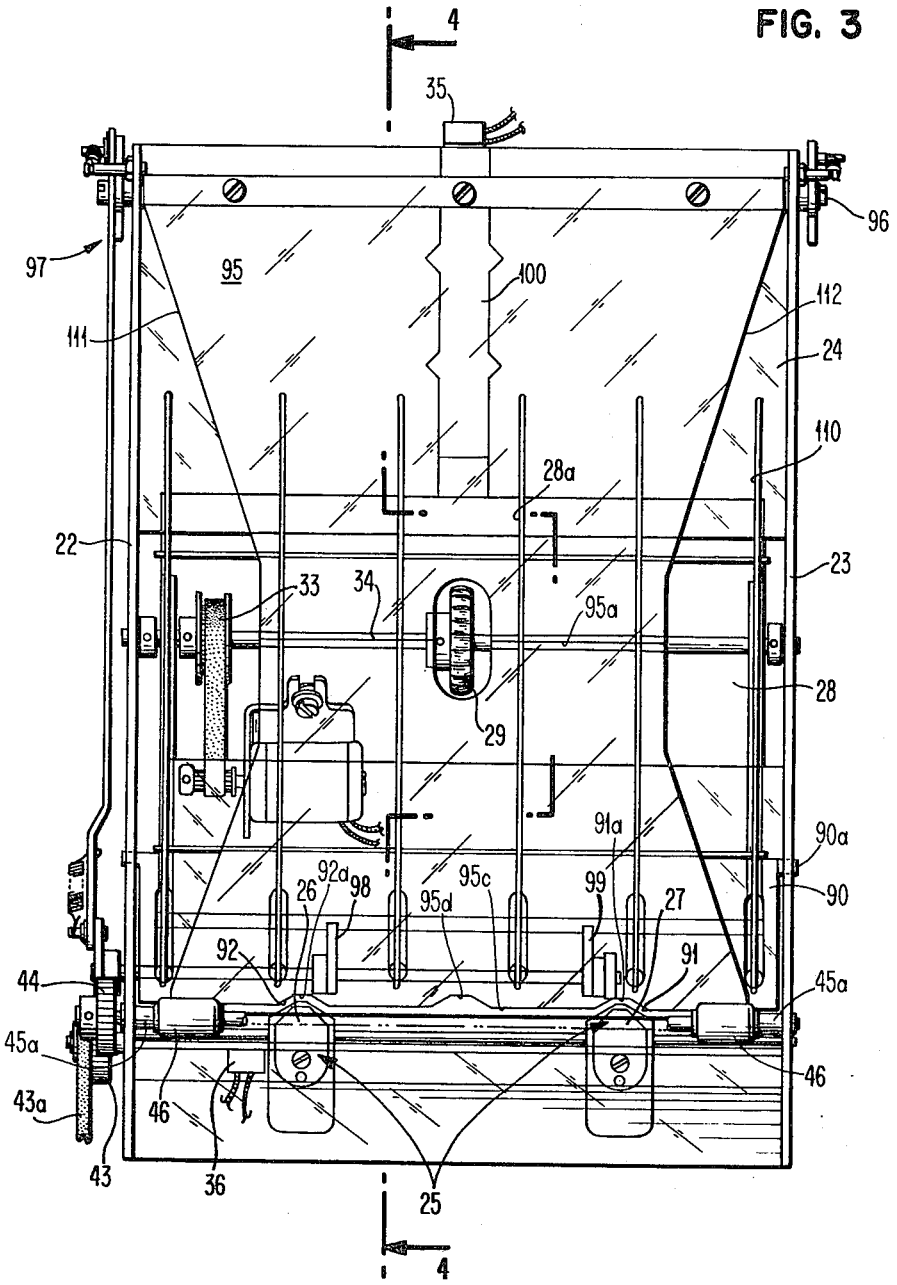
FIG. 3 is a plan view of the sheet feeder illustrated in FIGS. 1 and 2.
Figure 4:
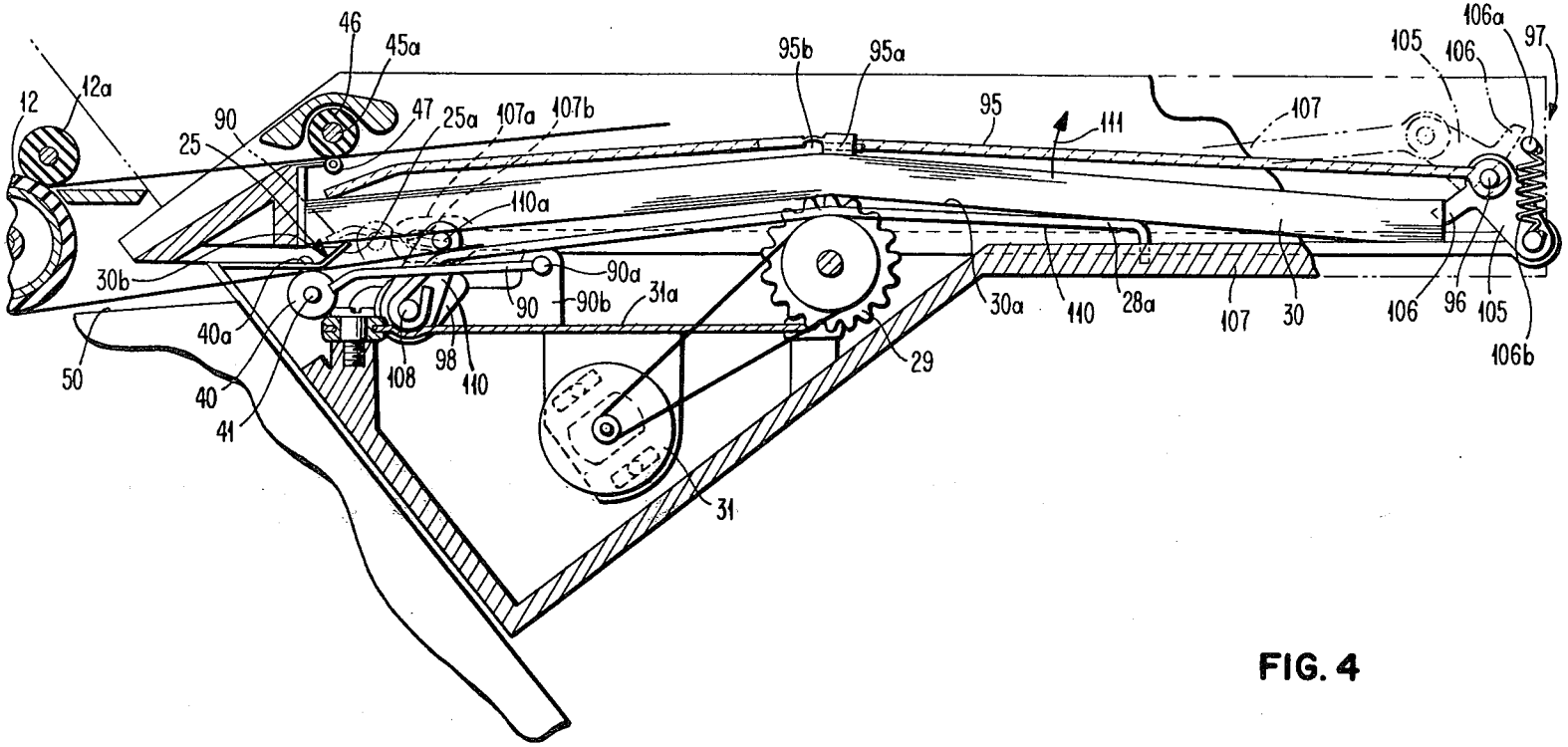
FIG. 4 is an enlarged fragmentary sectional view taken along line 4—4 of FIG. 3.

As shown best in FIGS. 2–4, the cover 95 is connected to the pivot shaft 96 so that upon rotation of the cover 95 the pivot shaft also rotates. Linkage 97, which is also coupled to the shaft 96, including a lever arm 105, projecting stop 106 and link 107 serves to effect rotation of cams 98 and 99 (FIG. 3) which bear against the support 90. The cams 98 and 99, by rotation around a shaft 108, move between a first recessed position below the fingers 26 and 27 into a second position above the plane of the fingers to cause the support 90 to be elevated above the plane of the fingers 26 and 27. To this end, the forward end 107*a* of the link 107 includes a lost motion slot 107*b* which is coupled to a pin 110*a* on a lever arm 110 connected to the pivot shaft 108. Upon rotation of the cover 95 from the position illustrated in FIG. 4 in the direction of the arrow 111, the link 107 pushes the pin 110*a*, due to its engagement in the slot 107*b*, causing rotation of the lever arm 110 counterclockwise, causing counterclockwise rotation (with respect to FIG. 4) of the cams 98 and 99 mounted on the shaft 108 effecting elevation of the support 90 from its recessed position, shown in solid lines, to the dotted line position because of the cam engagement with the support 90. Rotation of the cover 95 is limited by the projection 106 engaging a pin or stud 106*a*, the engagement being illustrated again in the dotted line position illustrated in FIG. 4. Additionally, intermediate the stop stud 106*a* and the lever arm or lever 105 is preferably overcenter biasing means, in the illustrated instance a spring 106*b* which serves to press the cover gently downwardly upon the bundle of paper 30. With the cover elevated, the paper bundle is placed with its one end on the rear support portion 24 and its other end on the support 90. When the cover 95 is rotated counterclockwise about the pivot shift 106, the support 90 is depressed into its first position, and the forward end of the paper bundle 30 is deposited on the fingers 26, 27, thus insuring no paper slippage beneath the fingers.

The cover 95 serves three functions: (1) to act as a weight against the bundle of paper 30, pressing the bundle against the shingler wheel; (2) to act as a separator between the bundle of paper 30 and finished typed paper deposited upon the cover as from the platen 12 in conjunction with an idler roller 12*a*, and drive roll 46; and (3) to serve as actuator means for effecting elevation and depression of the paper support 90, as described above. Preferably, the cover 95 includes a hinge 95*a* in the central portion thereof to permit ease of handling by the operator while allowing the operator to effect a fold of the cover at its mid-section to prevent the cover from standing to excessive heights when the cover is rotated in the direction of the arrow 111. Moreover, the cover preferably includes a "last sheet" pad 95*b* which serves, when the bundle or stack is down to a single sheet, to press the last sheet against the shingler wheel 29 so as to permit proper feeding of even the last sheet of paper in the bundle. A typical "last sheet" pad is shown in U.S. Pat. No. 4,175,741. The last sheet pad 95*b*, therefore, is preferably positioned on the underside of the cover opposite the shingler wheel as is the hinge 95*a*.

It should be noted that the shape of the cover is such as to facilitate removal of finished documents or papers from the top thereof, for example, and referring to FIG. 3, the laterally extending sides 111, 112 of the cover 95 are shortened at the central portion thereof along the hinge to permit the operator to easily grasp the finished documents from above the cover, the cover acting as a separator for the documents. Moreover, the cover includes cutouts 91*a* and 92*a* along the leading edge 95*c* thereof to effect clearance between the fingers 26 and 27 and the leading edge 95*c* of the cover. As shown, the cover may also include a finger slot or the like 95*d* which serves to allow the operator, if desired, to pick up the cover for rotation thereof about the pivot shaft 96.

In order to accommodate different paper lengths, it is preferably that the sensor 35, as illustrated in FIG. 1, be mounted on a slide 100 on the rear support portion 24 of the tray, the slide 35 being fitted into a groove 101 and detented as at 102, 103 so that the operator may choose the position of the first sensor 35 dependent upon paper lengths. Of course, it should be recognized that with suitable modifications the tray walls could be permitted to be moved laterally to accommodate papers of varying widths.

As best illustrated in FIG. 1, the sheet feeder is preferably set at an angle with respect to the typewriter 10 which facilitates the feed of paper to the platen 12. Thus the chute 50 will be preset at a particular angle for a particular typewriter and may easily fastened or connected to the rear cover or frame of the typewriter as by the angled stand 104 in a conventional manner, such as self tapping screws, wing nuts and bolts etc. or may be made a permanent part of the typewriter as desired. Moreover and referring now to FIGS. 3 and 4, a metallic wire support grid 110 having suitable opening 28*a* therein to permit the projection therethrough of the shingler wheel, is provided with a convex bow, the grid preferably being supported on the tray to insure bowing of the paper stack 30 in the desired direction, and by connecting the grid 110 to ground serves to bleed off electrostatic charges on the lowermost sheet 30*a* of the paper stack 30.

It also should be recognized that while the support 90 is the preferred manner for effecting positive placement of a bundle 30 upon the fingers or forward support portion, the cams 98 and 99 may be replaced with a plurality of cams spaced apart along the shaft 108 or may comprise a single projection which would permit raising or elevation thereof to permit positive placement of the bundle upon the forward support portion 25.

Accordingly, the present invention provides means for insuring proper positioning of a bundle of papers in a bottom sheet feed apparatus, while also providing weight against the paper stack with a suitable cover which also serves the purpose as a paper separator and as an actuator for the means that insures the positioning of the paper bundle in the bottom sheet feed apparatus.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed.

What is claimed is:

1. In a sheet paper feed apparatus for a printer having a platen for holding and providing at least longitudinal motion to a sheet of paper, said apparatus comprising a rectangular tray including a rear paper support portion and a spaced apart forward paper support portion, said portions for supporting thereon the opposite ends of a stack of paper, at least one shingler wheel intermediate said support portions for engaging the lowermost sheet of said paper sheet stack, and means for effecting rotation of said shingler wheel in a first direction to move the lowermost sheet of said stack away from said forward support portion until said lowermost sheet is no longer supported thereby, and then in the opposite direction to drive said lowermost sheet beneath said forward paper support portion, said forward paper support portion comprising a pair of inwardly projecting, spaced apart fingers, the improvement comprising:

paper stack lift means moveably mounted adjacent said fingers, and actuator means to effect movement of said paper stack lift means between a first recessed position below said fingers and a second position above said fingers so that upon loading of said stack of papers into said tray, said lift means is first placed in said second position by said actuator means, said paper stack impinging upon said rear paper support portion and said lift means, and then said lift means is moved to said first position by said actuator means to deposit said stack of paper on said fingers.

2. In a sheet paper feed apparatus in accordance with claim 1 wherein said paper stack lift means includes at least a pair of spaced apart cams mounted for rotation adjacent said fingers, and wherein said actuator means includes linkage means connected to said cam means.

3. In a sheet paper feed apparatus in accordance with claim 2 wherein said paper stack lift means includes a support shelf superimposed on said cams, and means pivotally mounting said support shelf so that upon rotation of said cams said shelf moves about said pivot means.

4. In a sheet paper feed apparatus in accordance with claims 2 or 3 wherein said actuator means comprises a cover moveable between a first position superimposed of said tray and into a second position exposing said tray.

5. In a sheet paper feed apparatus in accordance with claim 4 wherein said cover means is connected to said linkage means, and second pivot means for said cover means connected to said linkage so that said cover rotates about said pivot means effecting simultaneous motion to said cam means upon rotation of said cover means.

6. In a sheet paper feed apparatus in accordance with claim 5 wherein said cover has a narrower central portion than its opposite end portions.

7. In a sheet paper feed apparatus in accordance with claim 5 including hinge means on said cover to permit folding thereof.

8. In a sheet paper feed apparatus in accordance with claim 6 including stop means to restrict the rotation of said cover upon rotation of said cover into said second position.

9. In an improved sheet paper feed apparatus for a printer having a platen for holding and providing at least longitudinal motion to a sheet of paper, said apparatus comprising a rectangular tray including a rear paper support portion and a spaced apart forward paper support portion, said portions for supporting thereon the opposite ends of a stack of paper, at least one shingler wheel intermediate said support portions for engaging the lowermost sheet of said paper sheet stack, and means for effecting rotation of said shingler wheel in a first direction to move the lowermost sheet of said stack away from said forward support portion until said lowermost sheet is no longer supported thereby and then in the opposite direction to drive said lowermost sheet beneath said forward paper support portion, said forward paper support portion comprising a pair of inwardly projecting, spaced apart fingers, the improvement comprising:

a cover member mounted for rotation on said tray and dimensioned to fit within said tray superimposed of a stack of paper, and stack lift means mounted adjacent said fingers and moveable between a first recessed position below a plane defined by said fingers and said rear paper support portion and a second position above said plane, and means coupling said stack lift means to said cover member whereby upon rotation of said cover member away from said tray, said stack lift means assumes said second position and when said cover is in place superimposed of said stack, said lift means is in said first position.

10. In an improved sheet paper feed apparatus in accordance with claim 9 wherein said stack lift means includes a paper support shelf, and actuation means interconnecting said cover member, and said paper support shelf.

11. In an improved sheet paper feed apparatus in accordance with claims 9 or 10 wherein said stack lift means includes cam means mounted for rotation below said plane, including linkage means interconnecting said cam means to said cover member.

12. In an improved sheet paper feed apparatus in accordance with claim 11 including a laterally extending shaft on said tray adjacent said rear paper support portion and connected to said cover member to permit rotation thereof, a lever arm connected to said cover member and a link interconnecting said cam means to said lever.

* * * * *